United States Patent [19]

Verhoeven

[11] Patent Number: 4,992,052

[45] Date of Patent: Feb. 12, 1991

[54] MODULAR CONNECTOR SYSTEM WITH HIGH CONTACT ELEMENT DENSITY

[75] Inventor: Laurentius M. Verhoeven, Veghel, Netherlands

[73] Assignee: E. I. Du Pont de Nemours and Company, Wilmington, Del.

[21] Appl. No.: 301,381

[22] Filed: Jan. 25, 1989

[30] Foreign Application Priority Data

Feb. 1, 1988 [NL] Netherlands ..... 8800237

[51] Int. Cl.[5] ..... H01R 9/09

[52] U.S. Cl. ..... 439/62; 439/79; 439/636

[58] Field of Search ..... 439/62, 79, 342, 924, 439/636, 637, 157, 682

[56] References Cited

U.S. PATENT DOCUMENTS

| | | | |
|---|---|---|---|
| 3,413,594 | 11/1968 | Fernald et al. | 439/637 |
| 4,392,705 | 7/1983 | Andrews, Jr. et al. | 439/342 |
| 4,410,222 | 10/1983 | Enomoto et al. | 439/157 |
| 4,607,907 | 8/1986 | Bogursky | 439/682 |
| 4,659,155 | 4/1987 | Walkup et al. | 439/79 X |
| 4,684,194 | 8/1987 | Jenkins et al. | 439/636 |
| 4,734,042 | 3/1988 | Martens et al. | 439/62 |
| 4,806,103 | 2/1989 | Kniese et al. | 439/62 |
| 4,820,173 | 4/1989 | Thom et al. | 439/79 |
| 4,836,791 | 6/1989 | Grabbe et al. | 439/79 |

FOREIGN PATENT DOCUMENTS

| | | | |
|---|---|---|---|
| 282622 | 9/1988 | European Pat. Off. | 439/62 |
| 2005521 | 8/1971 | Fed. Rep. of Germany . | |
| 2214253 | 1/1973 | Fed. Rep. of Germany | 439/636 |
| 6810800 | 2/1969 | Netherlands . | |
| 86/01644 | 3/1986 | PCT Int'l Appl. . | |

OTHER PUBLICATIONS

*IBM Tech Disclosure Bulletin*, vol. 32, No. 5A, Oct. 1989, "High Density Edge Connector".

*IBM Tech Disclosure Bulletin*, vol. 30, No. 8, Jan. 1988, "Contractor Expansion of Electrical Connectors".

*Primary Examiner*—William Briggs

[57] ABSTRACT

A modular connector system wherein modules with high contact element density may be surface mounted to a printed circuit board. The connector modules achieve high contact element density by mutually displacing or offsetting the ends of adjacent contact elements in the same column in the direction of the row which extends in the longitudinal direction of the connector housing. The displaced ends are connected by surface mounting means to contact surfaces on the printed circuit board. A unique contact design is disclosed which can be used also in cable and other types of connectors. The modules construction permits many and different types of connectors to be mounted readily to a printed circuit board.

34 Claims, 6 Drawing Sheets

MODULAR CONNECTOR SYSTEM WITH HIGH CONTACT ELEMENT DENSITY

BACKGROUND OF THE INVENTION

This invention relates to a modular connector system and in particular to a system wherein connector modules with high contact density are surface mounted to printed circuit boards.

A connector module generally comprises a housing of electrically insulative material which accommodates a plurality of contact elements or terminals arranged in rows and columns. The contact elements have a base section and a contact end and connecting end extending from opposite ends of the base section. The connecting ends project outside one side of the housing and are connected to a printed circuit board.

There have long been attempts to accommodate electronic circuits in as modular a design as possible on printed circuit boards of standard dimensions. The interconnections between the individual modules and components, such as recorders, playback devices, etc., are preferably made via electronic connectors. As a consequence of miniaturization and due to the high density of present day integrated circuits, a large number of electronic components can be mounted on a printed circuit board so that a large number of functions can be carried out by a module of this type. The number of terminals needed for connection to other modules has, likewise, increased.

As a result, there is a great need for connectors with a high contact element density, i.e., with a large number of electrical contacts or terminals per unit of volume. The need for connectors with high contact element density has become even greater as a result of the advent of surface mounting technology whereby electronic components are surface mounted to the printed circuit board. Surface mounted devices (SMD) are not mounted on a printed circuit board via the usual pinhole connection but are connected directly to the surface of the printed circuit itself. By surface mounting techniques, it is possible to mount electronic components readily on either surface of a board without interfering with connecting pins which project through the board. This results in a component density which is even higher than that achieved with conventional pinhole connections and a further increase in the number of terminals.

In many cases the contact element density of a connector cannot be increased simply placing the contact elements closer together or by forming several rows of contact elements located above one one another. Generally, this results in an undesirable mutual electrical interference between the contact elements, essentially as a consequence of capacitive couplings between them. Furthermore, it is not possible in a connector to use an unlimited number of rows located above each other because contact elements with very long connecting ends to the printed circuit board will increase problems due to the occurrence of undesired inductive couplings and the circuit becomes more sensitive to electromagnetic noise signals.

It is futhermore necessary to maintain a defined minimum distance between the individual contact elements because the wall thickness of the housing in which the contact elements are accommodated must not become too thin in order to meet specified strength requirements. Moreover, from the viewpoint of mechanical strength of the printed circuit board, it is not desirable to connect several rows of contact elements to only one of its sides because with such an asymmetric arrangement, the board will tend to bulge in the center of the connector. This will result in an undesired force being applied to the board which may cause breaks in the thin printed circuit strips on the board.

One attempt to solve some of these problems is disclosed in U.S. Pat. No. 4,607,907 granted Aug. 26, 1986 to Robert Bogursky. FIG. 1 of this patent shows a contact element in which a tongue-shaped solder end extends from a U-shaped base section and projects, after mounting of the contact element, outside the connector for connection to a printed circuit board. In the case of a connector with several rows of contact elements arranged above each other, such as shown in FIG. 8 of this patent, the connecting ends of contact elements located in a column above each other are connected, by soldering, one behind the other to the printed circuit board in the direction facing away from the housing. As a result, the uppermost connecting end, as viewed from the printed circuit board, is relatively long and has therefore a large leakage inductance. To have sufficient room for the circuit tracks available on the printed circuit board for soldering of these connecting ends which are located one behind the other an increase in the number of contact elements in a row the mutual distance between these will have to be larger because from a design viewpoint and in order to obtain reliable connections, the width of the circuit tracks to these connecting ends must not be too small.

SUMMARY OF THE INVENTION

The present invention therefore has as one of its objects providing a connector module with a high contact element density in which the above-mentioned disadvantages of the prior art are largely overcome. This is accomplished by mutually displacing the connecting ends of adjoining contact elements in the same column in the direction of the row, i.e., in the longitudinal direction of the connector housing. This displacement may be accomplished by offsetting the connecting ends to extend within the side edge of the base section.

As a result of the mutual displacement, the connecting ends of the contact elements can be connected to a printed circuit board next to each other in a column, in a row direction or in a longitudinal direction as viewed from the housing. This minimizes the length of the connecting ends of the contact elements which are further away from the board and, therefore, results in corresponding reduction in the sensitivity to electromagnetic interference.

As a result of the mutually displaced arrangement of the connecting ends of the contact elements in a column, the connector module of the present invention is particularly suitable as an edge connector for connection to a printed circuit board. In this respect, the connector of the invention may in one embodiment have connecting ends which are inclined in the direction of an imaginary plane extending transversely to and in the longitudinal direction of side of of the housing for connecting the printed circuit board which is to be mounted in this plane on one or both sides.

In accordance with another embodiment, the connecting ends possess, near their free extremities, a flat portion for surface mounting to a printed circuit board according to the above. In yet another embodiment of the connector, the free extremities of the connecting ends are bent backwards relative to the imaginary plane in order to form a funnel which can readily receive the printed circuit board. A still further embodiment of the connector according to the invention has two rows of contact elements which are located on either side of the imaginary plane.

In order to keep the capacitive interference between adjoining contact elements as small as possible, the base section of the contact elements has to be designed so as to be flat, as shown in FIG. 3 of the above U.S. Pat. No. 4,607,907. A further embodiment of the connector according to the present invention has contact elements which are arranged in four rows and the connecting ends are designed as flat connecting tongues which form an integral part with the base section. The respective connecting tongues are located near an edge of the base section. In yet a further embodiment of the connector, the free extremities of the connecting tongues of adjoining contact elements in a column extend on one side of the imaginary plane over various distances from the housing in the plug-on direction of the connector.

As a result of the above-described displaced arrangement of the connecting ends in the plug-on direction of the connector, the respective connecting surfaces on the printed circuit board may also be arranged mutually displaced with respect to the edge of the board at the plug-on side. This is in contrast to connecting surfaces which must be arranged next to each other as in the case of connectors with terminals having connecting ends which terminate at the same distances. In comparison with connecting surfaces arranged next to one another, for a given pitch distance, the above-mentioned displaced arrangement of the connecting surfaces permits not only wider connecting surfaces, wider connecting ends and/or wider flat parts of the contact elements for connection thereof with the consequent associated greater mechanical strength, but inter alia, also increases the reliability during soldering of the connecting ends. Because the connecting surfaces are separated from one another by a relatively large distance, the risk of undesirable connections is thereby smaller than in the case of surfaces arranged next to one another. The smaller the pitch distance becomes and/or the larger the total contact element density of the connector becomes (several rows), the greater the advantage in the displaced arrangement in the plug-on direction of the connecting ends of the contact elements.

The contact elements of the invention are also fairly simple to manufacture. The contact elements have two separate connecting tongues, one of which is removed in the final assembled state in order to achieve the mutual displacement of the connecting ends of the adjoining contact elements.

Where surface mounting is employed, the displaced arrangement of the connecting ends in the longitudinal direction of the connector housing has the further advantage that the flat portions of the respective connecting ends do not slide during mounting over their respective connecting surface on the printed circuit board. This prevents soldering paste or electrically conductive adhesive which may be present on these connecting surfaces from being removed during fitting of the connector on the printed circuit board.

As a result of the flat design of the base section, a still further embodiment of a connector module according to the invention may have a housing wall thickness on the end faces which is smaller than or equal to half the pitch distance between the contact elements, arranged so as to adjoin each other in a row. The connectors designed in this way can be mounted with the end edges up against each other without losing space for a column of contact elements. This is particularly advantageous in the case of printed circuit boards requiring connectors with a high contact element density.

To relieve as much as possible stress due to any compressive, bending or tensile forces in the connections between connector and board and to achieve good mechanical and/or electrical screening of the electronic components located on the printed circuit board and of the connector itself, a further embodiment of the connector module according to the present invention has formed in the housing on the side from which the connecting ends of the contact elements project outward at least one row of openings extending in the longitudinal direction of the housing and adjacent to a side wall thereof. These openings interact with a protective plate which is provided near at least one of its edges with teeth for insertion in at least one row of openings in the housing of the connector in a manner such that, in the assembled state, the protective plate extends parallel to the aforenoted imaginary plane.

A preferred embodiment of the protective plate has teeth which are formed on an elongated rail of electrically insulating material. The rail is disposed near an edge of the protective plate and the teeth are situated at a distance from the surface of the protective plate. As a result, the openings formed in the protective plate surface permit the plate to be secured to the printed circuit board in a manner which provides a strong mechanical connection between the connector and the printed circuit board.

As discussed above, a high contact density is achieved with the connector module according to the invention and in particular with the connector having four rows. In practice, it is possible for only some of the contact elements of one connector to be connected with some of the contact elements of the other connector or a printed circuit board. To provide interconnection between connector modules, there is furthermore provided, according to the invention, a cable connector module for a ribbon cable, which connector comprises a housing of electrically insulating material with several contact elements arranged in rows and columns and having contact ends and a connecting end, constructed as a plug-on contact, of electrically conducting material for connecting a conductor (i.e. core) of the ribbon cable. The cable connector has several open channels extending in the column direction of the contact elements, from one side of the housing to the other, for receiving the conductors of the ribbon cable from one side, only one plug-on contact being located in each channel and the contact elements situated adjacent to the other side of the 4 housing being arranged in a manner such that, if two cable connectors are positioned with the other sides situated opposite each other, the respective contact elements in one and the same column are separated from each other by a distance of at least one position.

The through channels make easy assembly of the ribbon cable possible. In the case of two cable connectors located opposite each other and connected to, for example, a four-row connector according to the invention, the displaced sitting of the contact elements achieves the result that, the ends, lying opposite each other, of the individual cores of the ribbon cables connected to the respective cable connectors always have a mutual distance equal to the width of one row. Accordingly, there is no danger of the conductors situated opposite each other being able to make electrical contact with each other, assuming that the end to be connected of each ribbon cable is finished in accordance with the position of the contact elements.

A preferred embodiment of the cable connector according to the invention comprises two rows and an even number of columns. The plug-on contacts situated in adjacent channels are each arranged in another row.

By using contact elements with a flat base section, the external dimensions of the cable connector are such that no space is lost for one or more of the contact elements. As a result, two or more cable connectors may be connected directly adjoining, for example, a four-row connector according to the invention.

The present invention further relates to a contact element of electrically conducting material and, in particular, one for use in connector or cable connector modules such as described above. The contact element has a flat base section and a contact end having two resilient contact fingers projecting from the flat base section with contact surfaces located at the fee ends thereof. The contact fingers extend symmetrically relative to the center line in the longitudinal direction of the contact element and, at the extremity connected to the flat base section, are bent out of the plane of the base section over a portion of their length in opposite direction. The two contact fingers are bent towards each other again at the end of this portion in a manner such that the contact surfaces are located opposite each other. With such a contact element, an equal and relatively small mutual space can be achieved between adjoining contact elements of the connector.

The invention also relates to a power connector module comprising at least one contact socket or contact pin, surrounded by a housing, with an elongated connecting end of electrically conducting material for connecting the power connector to a printed circuit board. The connecting end is provided with a slot-shaped opening in which the printed circuit board can be received for connecting the power connector to one or both flat sides thereof by surface mounting. Power connectors of this type are used, in particular, for connecting supply lines.

The invention furthermore relates to a coaxial connector module comprising at least one outermost and innermost contact socket or innermost contact pin, mutually electrically insulated and surrounded by a housing, and having connecting ends of electrically conducting material for connecting the coaxial connector to a printed circuit board. The outermost contact socket has a connecting end for connecting it to one side of the printed circuit board and the innermost contact socket or innermost contact pin has a connecting end for connecting it to the other side of the printed circuit board by the surface mounting.

In this application, the term "printed circuit board", which is also commonly referred to as "printing wiring board", is understood as meaning, in general, substrates with conducting tracks and thus, for example, also substrates of liquid crystal displays.

The invention also relates to a contact element with a flat base section for use in the connector or cable connector modules according to the invention. The contact end of the contact element is a contact pin projecting from the base section.

A connector or cable connector modules according to the invention may be provided with several such contact elements. The contact pin of at least one of the contact elements in a column has an unequal length relative to the contact pins of the other contact elements in the same column.

In the text which follows, the invention will be illustrated in detail by reference to drawings of preferred embodiments of a connector by surface mounting techniques, a protective plate, a cable connector for a ribbon cable, power connectors and coaxial connectors for surface mounting technique.

DETAILED DESCRIPTION OF THE EMBODIMENTS

Figure 1:
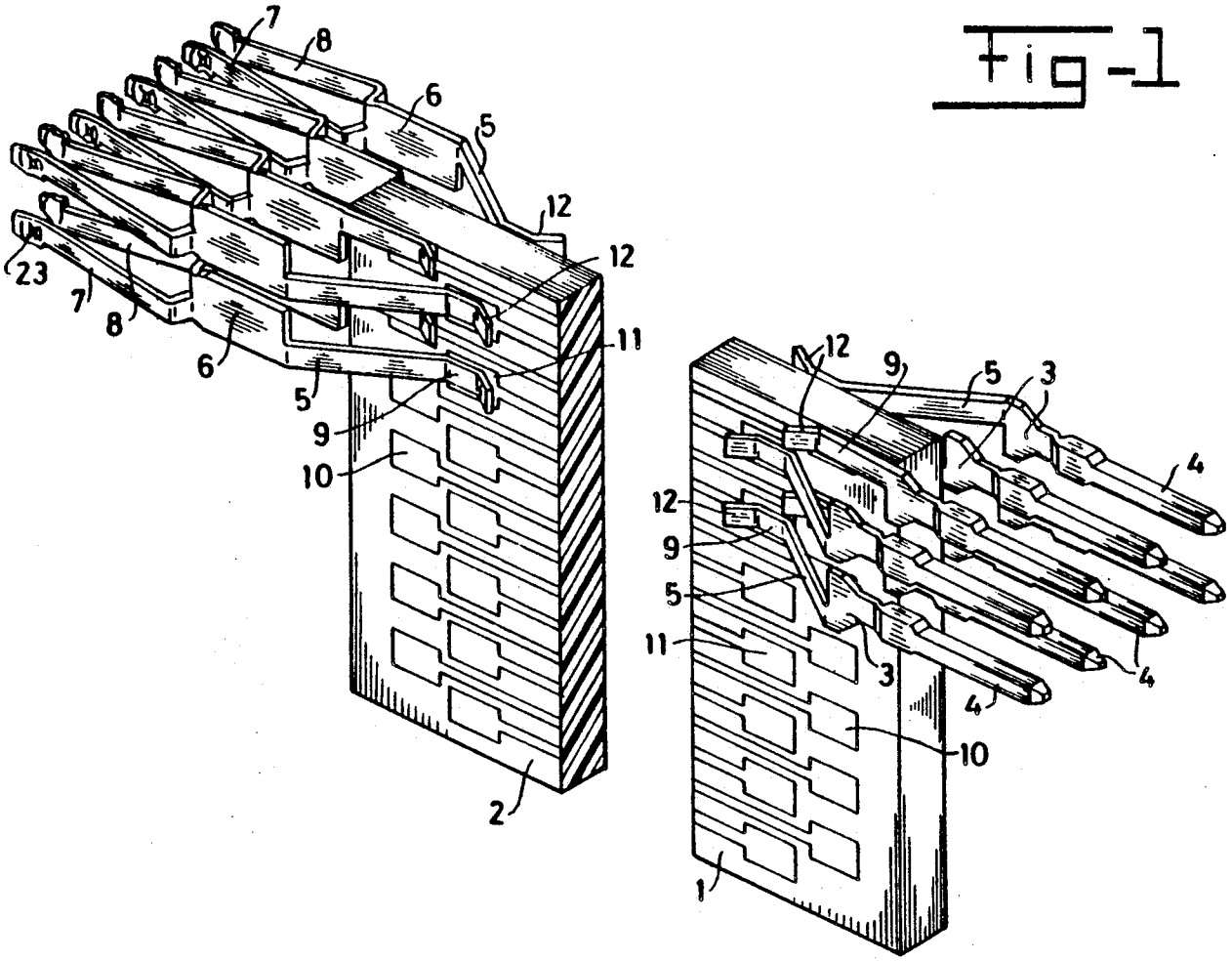
FIG. 1 shows diagrammatically in perspective two different embodiments of contact elements according to the invention which are connected on either side to a printed circuit board.

FIG. 1 shows diagrammatically in perspective two embodiments of contact elements of electrically conducting material, located on either side of a printed circuit board 1, 2 with connecting ends arranged for surface mounting to the board. The printed circuit board 1, 2 is essentially located in the middle between four rows of contact elements arranged in columns, only two elements in each row being shown in FIG. 1.

In the case of the contact elements shown on the right-hand side of FIG. 1, a contact pin 4 and a flat connecting tongue 5, respectively, extend in opposite direction from a flat base section 3. In the case of the contact elements shown on the left-hand side of FIG. 1, contact fingers 7, 8 extend in one direction and a flat connecting tongue 5 extends in the other, opposite direction from a flat base section 6.

As can be seen in FIG. 1, the connecting tongues 5 of the various contact elements are arranged so that they adjoin each other in a column and are connected to the printed circuit board 1, 2 so as to be mutually displaced in the longitudinal direction. The connecting tongues are inclined in the direction of the printed circuit board 1, 2 and extend from an edge of the flat base section 3 or 6. The connecting tongues 5 have, near their free extremity, a flat portion 9 located parallel to the board 1, 2 for surface mounting to connecting surfaces 10, 11 on the printed wiring board 1, 2. Connecting surfaces 10 are arranged in one row nearer to the edge at either side of the board while connecting surfaces 11 are also arranged in a row further from the edge of each side of the board. The contact elements of the innermost rows are situated directly adjacent to the printed circuit board 1, 2, the flat portion 9 of these contacts units are situated virtually in the plane clamped by the respective flat base sections 3, 6. The flat portion 9 of the contact elements actually merges smoothly into the connecting tongue 5 of these contact elements. The connecting tongues 5 do not always have to be flat, however, but may, for example, also have a round, elliptical or polygonal cross-section and/or may be narrower than the flat portion 9 for connecting to the connecting surfaces 10, 11 of the printed circuit board 1, 2. The connecting tongues 5 further have a free extremity 12 which is bent backwards at an angle relative to the printed circuit board 1, 2.

In FIG. 1, the connecting tongues 5 located on each side of the printed circuit board 1, 2 are connected to connecting surfaces 10, 11 lying displaced in the plug-on direction of the connector, transversely to the board 1, 2. In other words as noted above, surfaces 10 are arranged in 6 rows nearer the edge of each side while surfaces 11 are also arranged in a row further from each edge. In this arrangement, the center elements of the innermost rows described above contact surfaces 10. The outer row of contact elements elements have connecting tongues more inclined to their respective base sections 3, 6 and the board 1, 2 and contact surfaces 11 on either side of the board. It is, however, also possible to connect the flat portions 9 for surface mounting/connection of the connecting tongues at an equal distance from the edge of the printed circuit board 1, 2 in which case the connecting tongues 5 and the connecting surfaces 10, 11 then lying next to each other should have suitable dimensions in order to avoid undesired electrical contact. With one and the same pitch distance, however, it is possible, as a consequence of arranging the ends of the connecting tongues 5 of adjacent contact elements, as shown so as to project over different distances from the housing in the plug-on direction of the connector to use relatively wider connecting surfaces 10, 11 than in the case where the connecting tongues extend over an equal distance from the housing where connecting surfaces 10, 11 on the printed circuit board are situated next to each other, i.e., in the same row. Wider connecting surfaces or wider connecting tongues 5 and/or wider flat sections 9 thereof mean not only a mechanically stronger connection to the printed circuit board, but also a more reliable solder joints. Because the soldered surfaces are relatively far removed from each other in the case of the displaced arrangement shown of the connecting surfaces 10, 11, the risk of undesirable solder connections is in this case less than in the case of connecting surfaces 10, 11 situated next to each other in a row. As the pitch distance of the contact elements decreases, there is an increasingly greater advantage in the displaced arrangement of the connecting surfaces.

In the preferred embodiment shown in FIG. 1, the connecting tongues 5 of the respective contact elements extend in each case from the edge of the respective flat base section 3, 6 and form an integral part therewith. It will be clear that the connecting tongues 5 can also be arranged so as to be displaced relative to the edge of each flat base section 3, 6 and can also extend, for example, from the center thereof. Contact elements with connecting ends mating sideways and in the middle of the base section can then be used, as shown in FIG. 1, for connectors consisting of six rows of contact elements, i.e., three on either side of the board 1, 2.

It is, of course, not essential that the printed circuit board 1, 2, as mentioned earlier, be disposed in the middle between the rows of contact elements, the connecting ends can be arranged in such a way that, for example, three rows of contact elements can be located with the respective connecting ends on one side of the printed circuit board 1, 2 and, for example, only one or two rows on the other side, according to the positioning of the connecting ends. Furthermore, it is also not essential that the contact elements be connected on both sides of the printed wiring board, although such a symmetrical arrangement is preferable in the case of connectors with a large number of contact elements because of the warping of the board and the risk of tearing of the thin conducting racks on the board.

As a result of the mutually displaced arrangement of the connecting tongues 5, the flat portions 9 alone slide over only those connecting surfaces 10, 11 on which they are connected so that any solder or adhesive paste present on these connecting surfaces is not damaged or pushed away by a connecting tongue other than that to be connected to a corresponding connecting surface sliding over it. The contact surfaces 10, 11 may, of course, have another suitable shape for connecting the contact elements which differs from the rectangular shape shown.

Figure 2:
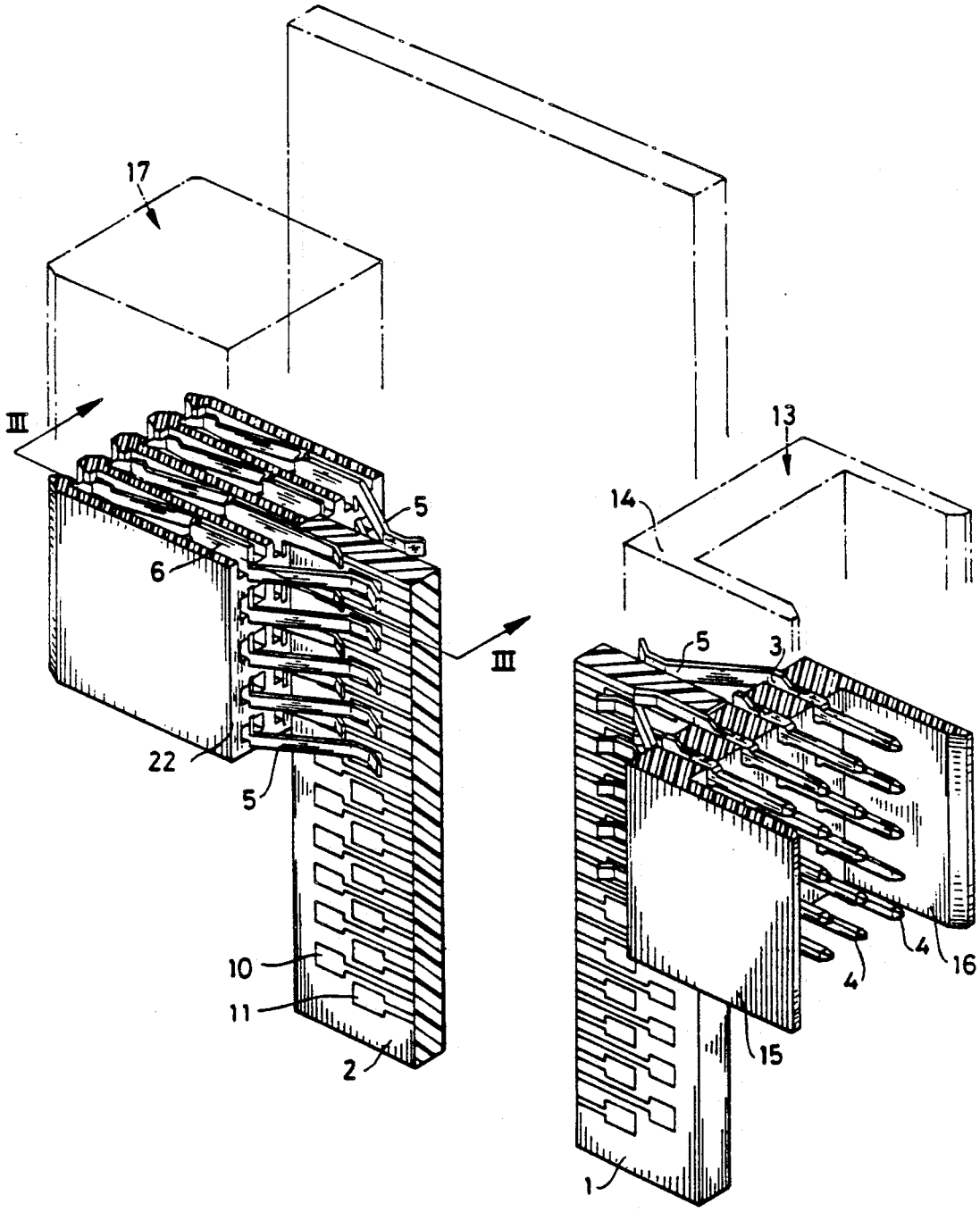
FIG. 2 shows diagrammatically in perspective partially cut-away embodiments of a connector according to the invention, with the contact elements according to FIG. 1.

FIG. 2 shows diagrammatically in perspective and impartially cut-away form two embodiments of a connector module according to the invention in which the contact elements of FIG. 1 are used. The connector housing 13, shown on the right-hand side of FIG. 2, the contact ends of the contact elements are designed as contact pins 4 is open on the side facing away from the printed wiring board 1. The contact pins are fastened in the rear wall 14 of the housing 13 which is arranged against the edge of the board. The side walls 15, 16 of the connector 13 have a mutual distance such that a connector 17 shown on the left-hand side of FIG. 2 can, for example, be arranged therebetween with the contract fingers 7, 8 making electrical contact with the contact pins 4. The contact elements shown on the left-hand side of FIG. 1 are fixed in the rear wall 22 of this connector 17.

As can be seen in FIG. 2, the narrow edges of the flat base section 3, 6 of the contact elements, arranged so as to adjoin each other in a row, are located opposite each other while the broad surfaces of the flat base sections 3, 6 of the contact elements, arranged so as to adjoin each other in a column, are located opposite each other. As is known, the capacitive interference between two adjoining contact elements is directly proportional to the surface of the broad sections lying opposite each other and is inversely proportional to the distance therebetween while the distance between the contact elements arranged in FIG. 2 so as to adjoin each other in a row is relatively small, thus implying a large capacitive coupling therebetween the fact that the narrow edges of the flat base sections 3, 6 are the surfaces opposite each other results in relatively small capacitance. The converse applies to the contact elements arranged so as to adjoin each other in a column. There the broad surface of the base sections 3, 6 are located opposite each other is in fact now relatively large but because the distance therebetween as a result of the illustrated sitting of the contact elements is also relatively large, the resulting capacitive interference remains small. The connecting tongues 5 themselves may be connected, as shown, directly to the printed circuit board 1,2 and may be relatively short, which is an advantage in connection with the sensitivity to electro-magnetic interference and inductive couplings between the respective connecting tongues.

As a result of the above-described arrangement, the usual minimum pitch distance of 2.54 mm between the contact elements adjoining each other in rows and columns can then be advantageously reduced to 2 mm or less. This results in a considerable space saving, in particular in the case of connectors with a large number of contact elements, thus achieving a higher contact element density in a connector of given dimensions.

Figure 3:
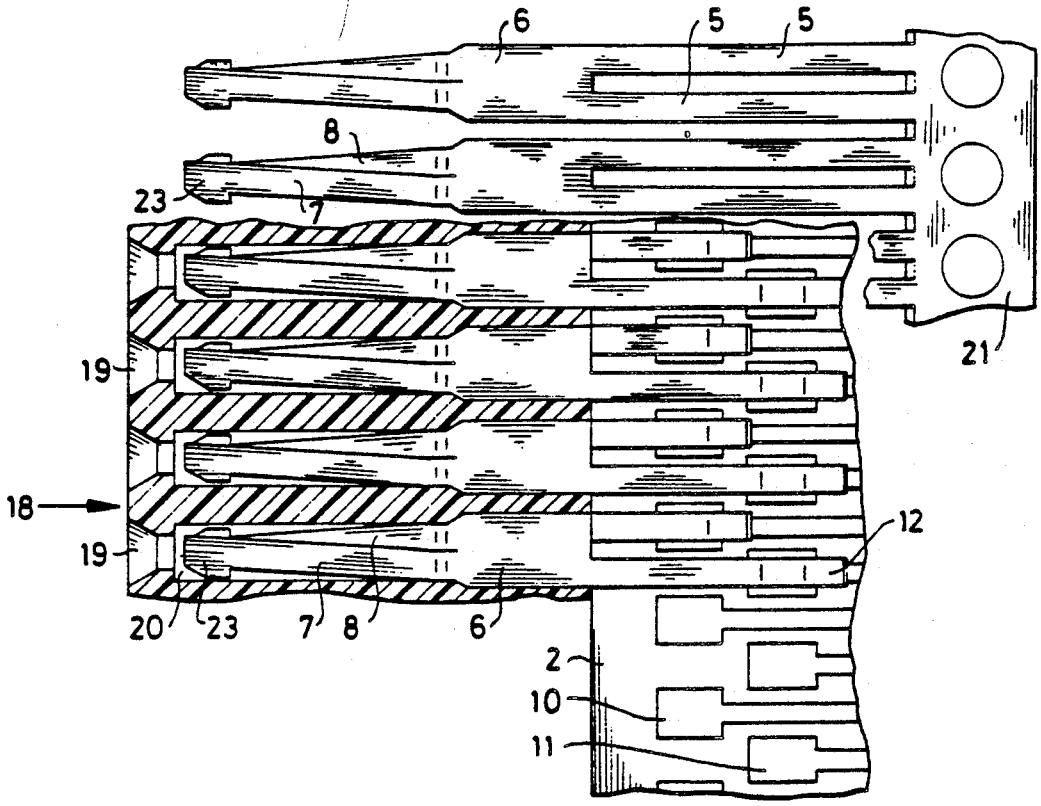
FIG. 3 shows, on an enlarged scale, a partial longitudinal section along the Line III—III through the connector shown on the left-hand side of FIG. 2, in which the contact elements are connected with their connecting ends to a carrier strip.

FIG. 3 shows, on an enlarged scale, a partial section along the Line III—III in the longitudinal direction of the connector 17 shown in FIG. 2 and connected to the printed circuit board 2. This connector has, on the front side 18 facing away from the printed wiring board, openings 19 which expand towards the outside and in which a contact pin can be inserted for contacting the resilient contact fingers 7,8 extending from the flat base section 6. FIG. 3 also shows that the contact elements can all be manufactured in the same way; namely, by manufacturing them with the two connecting tongues 5 connected to a carrier strip 21. During assembly of the connector, one connecting tongue is subsequent removed, the other connecting tongue is brought to the required length and the flat section 9 and the bend 12 are formed. It will be clear that such a universal contact element offers great advantages during assembly of a mass-produced article such as a connector.

Figure 4:
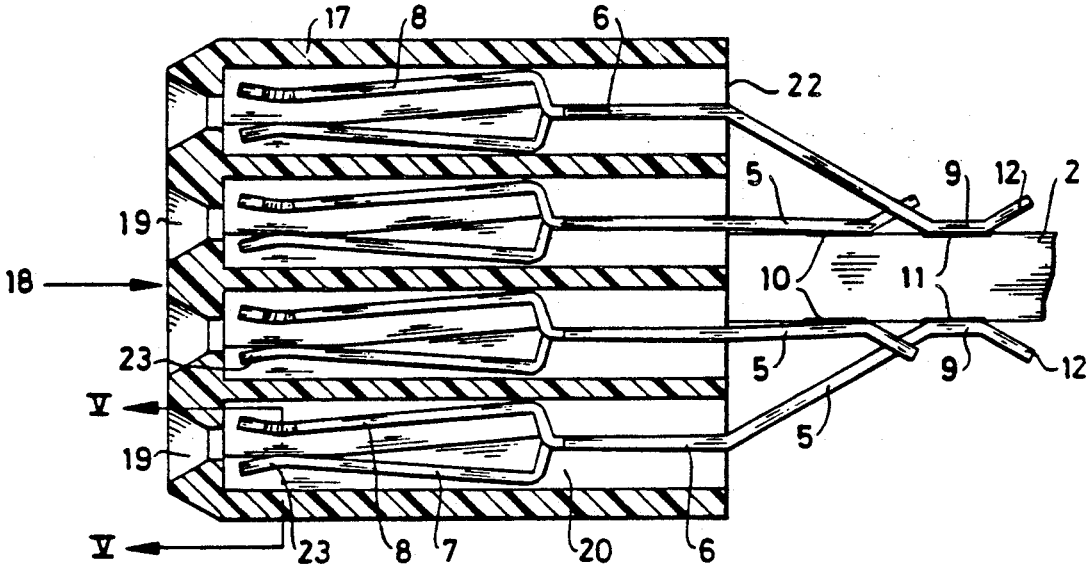
FIG. 4 shows, on an enlarged scale, the section through the connector shown on the left-hand side of FIG. 2.

FIG. 4 shows, on an enlarged scale, the cross-section through the connector 17 shown in FIG. 2. The contact fingers 7, 8 are bent, on the extremity connected to the base section 6, over a section of their length in opposite direction out of the plane of the base section 6. The two contact fingers 7, 8 are bent towards each other again at the end of this section and the contact surfaces 23 are located at the free extremities lying above each other (see also FIG. 3). In order to prevent displacement in the longitudinal direction of the contact elements and to influence the 4 contact properties of the contact fingers, raised portions and guides (none shown) may be fitted in the channel 20 of the connector 17. The sections of the contact fingers 7, 8 bent out of the plane of the base section 6 may rest against these raised portions and guides.

Figure 5:
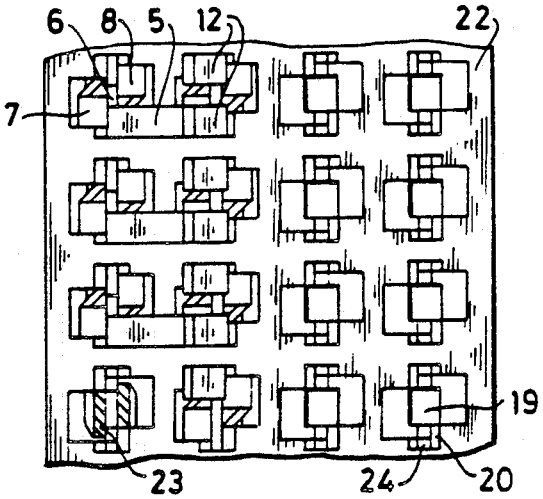
FIG. 5 shows, on an enlarged scale, a rear view of the connector shown on the left-hand side of FIG. 2, the left half of which is shown provided with contact elements.

FIG. 5 shows, on an enlarged scale, a view facing the rear wall 22 of the connector 17 in FIG. 2 in which the connecting tongues 5 project to the outside. For the sake of simplicity only, the left-hand two rows are provided with contact elements in the drawing. The flat base sections 6 of the contact elements are clamped in slits 24 in the rear wall 22 of the connector. At the bottom left in FIG. 5, differing from the other views, a section along the line V—V in FIG. 4 is shown for one contact element, the hatched sections being the contact surfaces 23 of the contact fingers 7, 8 (see also FIG. 1). The contact surfaces 23 may be made flat or curved.

As can be clearly seen from FIG. 5, the slits 24 for receiving the flat base sections 6 or 3 are situated in the center of the channels 20. As a result, the capacitance between adjacent contact elements has the same low value over the whole connector. This arrangement of contact elements is possible as a consequence of the fact that the contact fingers 7, 8 are bent in the opposite direction out of the plane of the flat base section 6.

The contact pins 4 in a column of the connector 13 shown on the right-hand side of FIG. 2 may be of mutually different lengths (not shown). The longest contact pin, for example, can be used for grounding purposes, the next shortest contact pin for providing the supply voltage and the other still shorter contact pins can, for example, be used for signal paths. These last mentioned contact pins may be of equal length. On contacting a connector constructed in this manner, contact is first made with the ground contact pin, then with the supply contact pin and then with the signal contact pins. This advantageously ensures that the apparatus is always connected first to ground so that any fault currents as a result of short circuits or static charge and the like can flow away directly. The contact pins 4 may also have a section differing from the rectangular shape shown, such as, for example, a truncated elliptical form.

Figure 6:
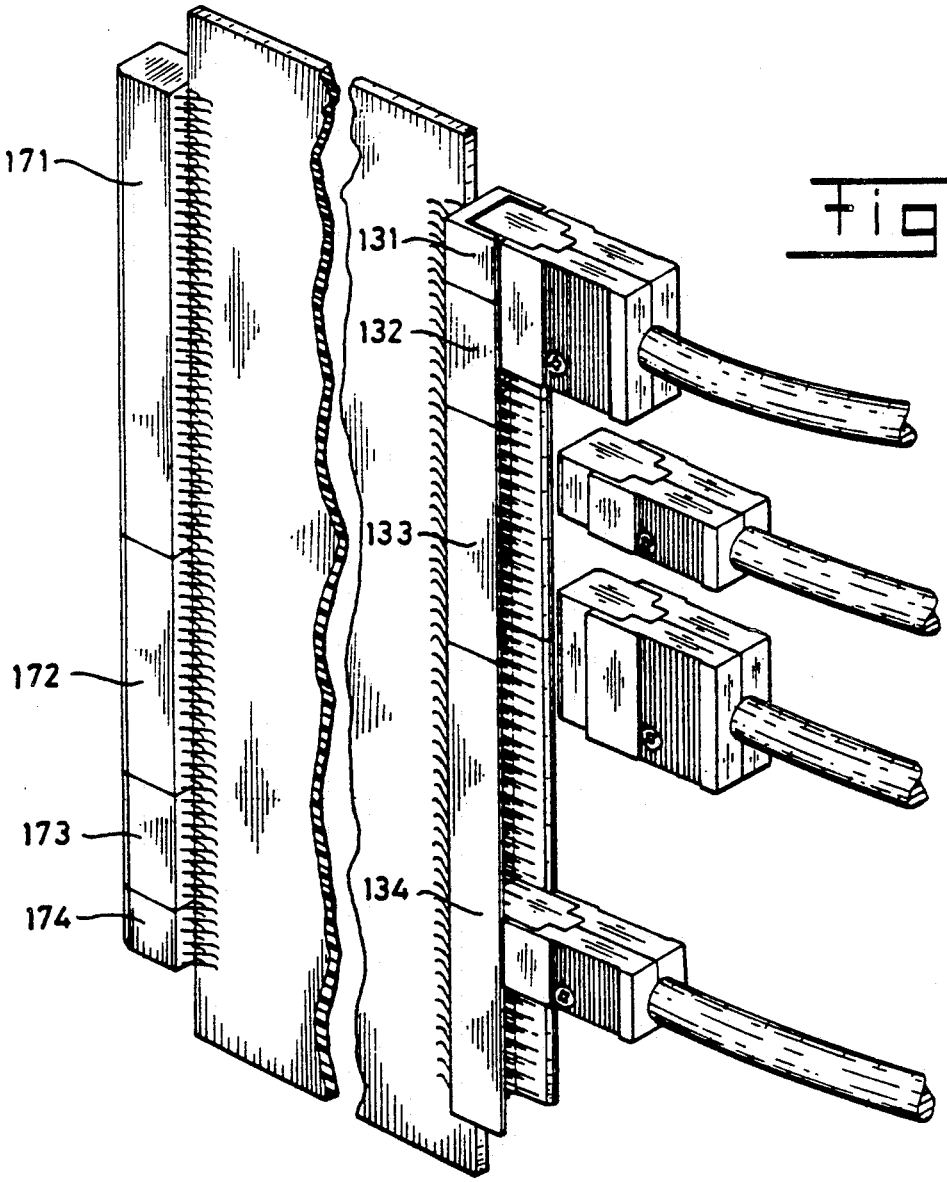
FIG. 6 shows diagrammatically in perspective a number of connectors, mounted next to each other, for surface mounting according to the invention.

FIG. 6 shows a row of the connector modules 131–134, 171–174 of varying lengths constructed according to the invention. As is clearly visible, long rows of connector modules can be formed without loss of space for a contact element. To permit this, however, the wall thickness at the end faces of the connectors 13, 17 shown in FIG. 2 is smaller than or equal to half the pitch; that is to say, the distance between two adjoining contact elements in a row.

The invention is described above by reference to preferred embodiments of symmetrical connectors which are surface mounted. It should be clear that the arrangement of the connecting ends of the contact elements according to the invention can also be used connectors with conventional pin/hole connections in connectors with so called wire-wrap connections, in which case the connecting ends are pins projecting to the outside.

The contact elements may advantageously be made of flat spring material. The housing of the connector may be made of thermoplastic polyester resin, such as "Rynite" FR-530 produced by the Du Pont Company. This material makes possible to construct a connector with a smaller wall thickeners which is resistant to the higher temperatures which may arise in vapor phase soldering (VPS) while maintaining mechanical strength and breaking resistance.

Figure 7:
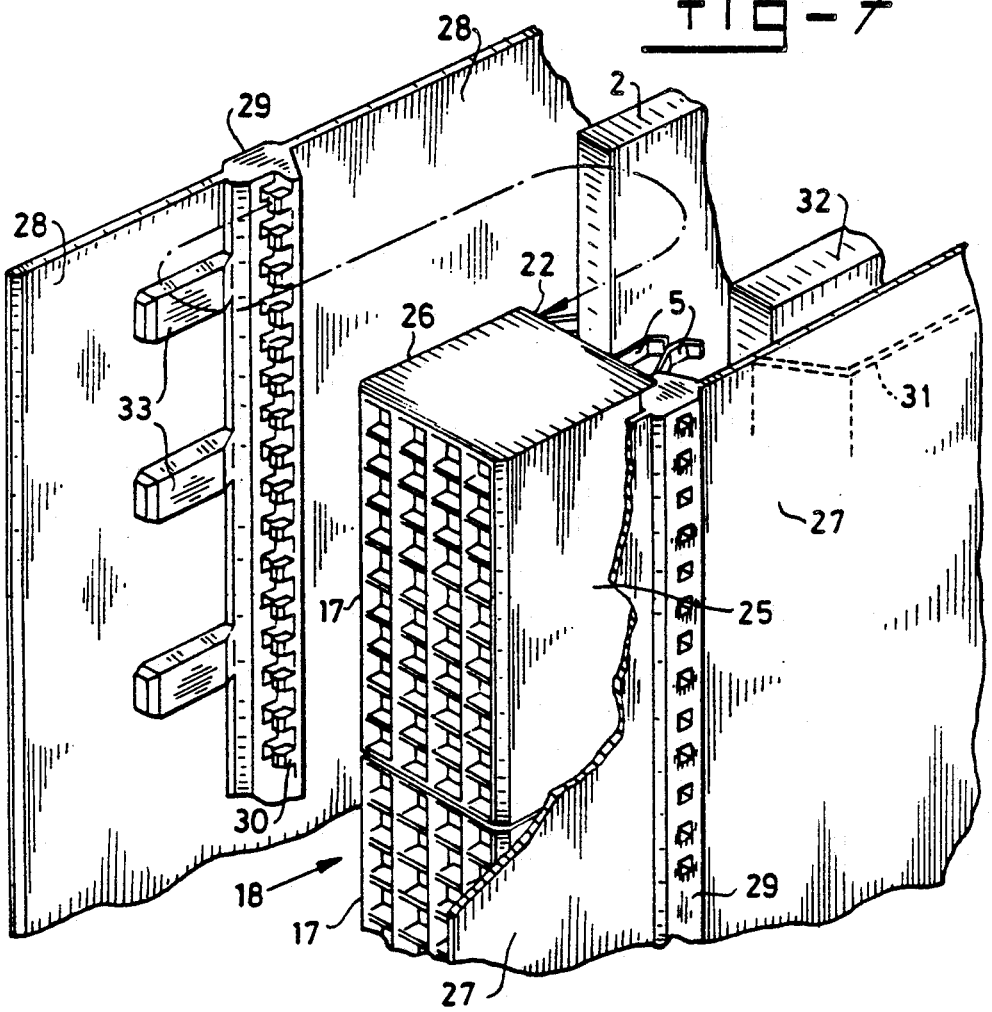
FIG. 7 shows, in perspective, a partial diagram of an unassembled protective plate provided with teeth and shows, in a partially cut-away view, a protective plate connected to two connectors according to the invention.

FIG. 7 shows, in perspective, a partial diagram of two connector modules 17 which are connected mounted one above the other to a printed wiring board 2. A protective plate 27 is shown on the right-hand side of the connectors 17, viewed from the contact openings thereof. The protective plate 27 is located parallel to the right-hand sidewalls 25 of the connectors 17 at a distance above the printed circuit board 2. The portion of the protective plate 27 situated opposite the right-hand sidewall 25 extends beyond the connectors 17 and is shown partially cut-away. The protective 27 is further provided with an elongated rail 29. A similar protective plate 28 having rail 29 is shown parallel to the left-hand sidewall 26 of the connectors 17.

The rail 29 is provided with teeth 30 projecting parallel to the plane of the respective protective plates 27, 28 in the direction of the front 18 of the connector 17. The teeth 30 are mutually insulated electrically relative to each other and relative to the protective plate. For this purpose, the rail 29 can advantageously be made of a plastic by means of, for example, an injection moulding technique.

As indicated by a broken-line arrow in FIG. 7, the teeth 30 have to be inserted in the connectors 17 on the rear side 22. The mutual distance between the teeth 30 and the dimensions thereof are such that they can be received adjacent to the base sections 6 of the contact elements of the outermost rows of the connectors 17 in the channels 20 shown in FIG. 4. Other suitable openings for receiving the teeth 30 may also be disposed in the rear wall 22 in a manner such that in the assembled state the protective plate extends parallel to the printed circuit board, as shown in FIG. 7.

For mechanical protection of the electronic components fitted to the printed circuit board 2 (which are indicated by 32 in FIG. 7), the protective plates 27, 28 may be manufactured from a suitable plastic material. In order to obtain good electrical screening, the protective plates may be manufactured from electrically conductive material or form, for example, plastic with an electrically conductive layer applied thereupon. The protective plates can also comprise several plate sections connected together, if necessary.

As also shown in FIG. 7 with broken lines 31, it is not necessary for the protective plates to extend over their entire surface in the same plane but they may also be designed such that they partially extend at a greater or partially at a smaller distance above the printed wiring board 2. To prevent errors as much as possible during contacting of the connectors 17, or to avoid erroneous connections being made, positioning projections 33 which may be broken away are formed on the rail 29.

Figure 8:
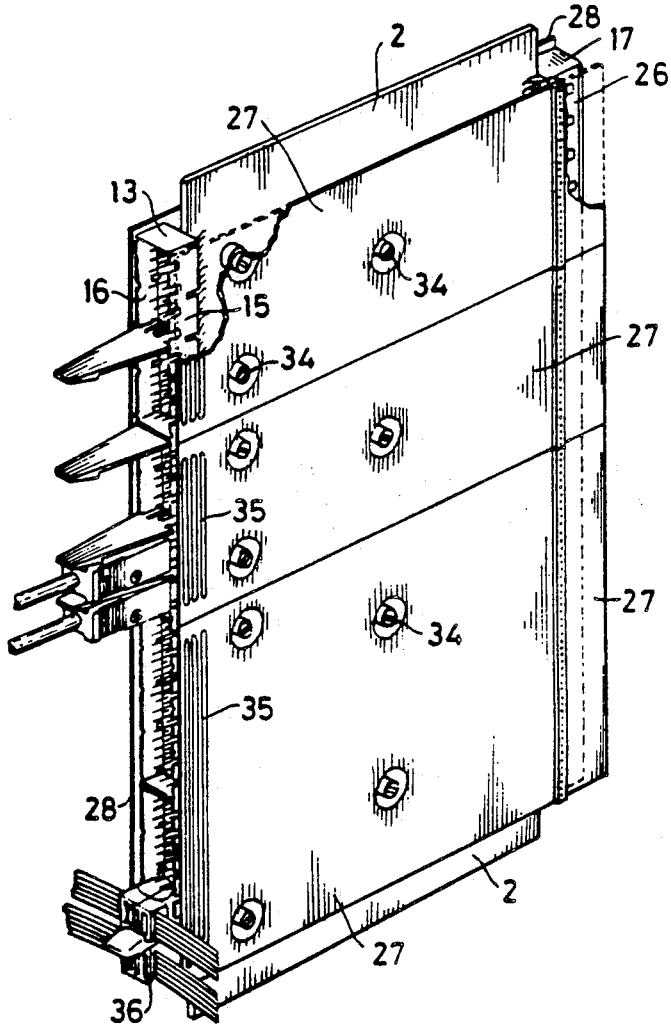
FIG. 8 shows diagrammatically in perspective several protective plates located next to each other and on either side above a printed wiring board, which protective plates are fixed in accordance with FIG. 7 to a number of connectors mounted next to each other, as shown in FIG. 6.

FIG. 8 shows a printed circuit board 2 with connectors according to the invention fitted on opposite sides. Several protective plates 27, 28 of different dimensions are mounted on the two flat sides of the printed wiring board 2. Openings 34 are formed in the protective plates 27 in a manner such that the protective plates can be mechanically connected to the printed circuit board 2 by means of, for example, screws and spacers. This results in the desired strong mechanical connection between the diverse connectors and the printed wiring board. At the position of the sidewalls 15, 16 of the connectors 13, the protective plates are provided with ribs 35 extending in the longitudinal direction of the connectors 13. This increases the mechanical stability of the protective plates and prevents the protective plates from being bent during rough contact of the connectors 13. It should be clear that ribs 35 extending in the transverse direction (not shown) across the protective plates may also be provided with the same object.

Figure 9:
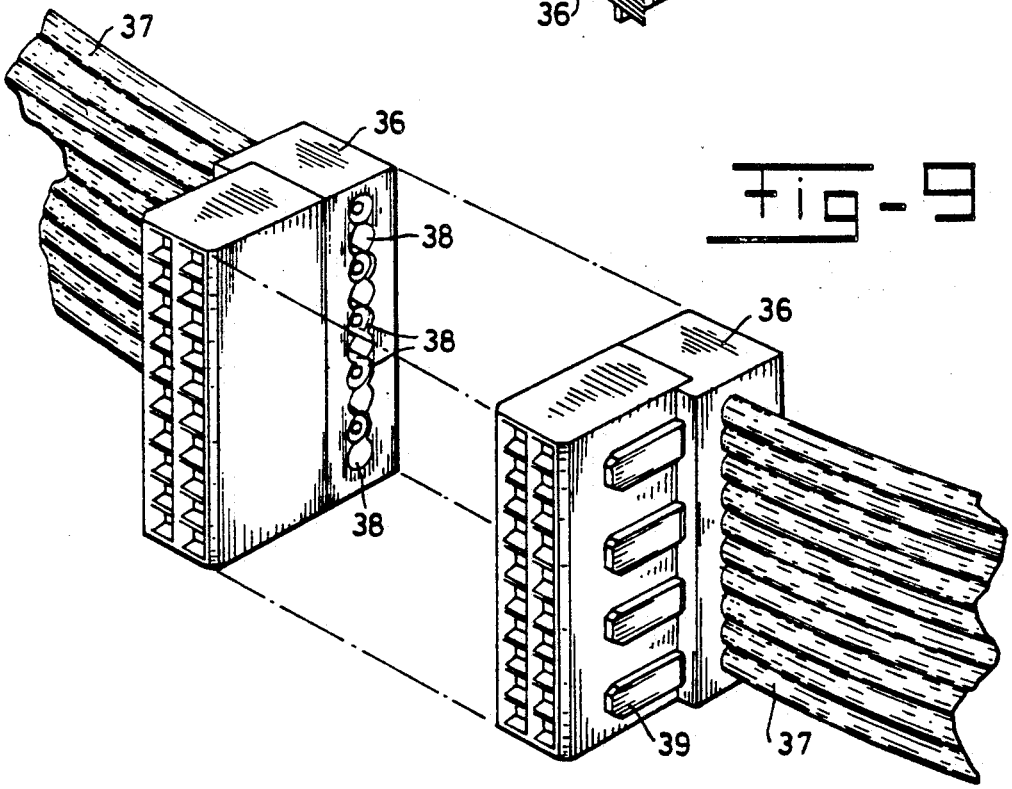
FIG. 9 shows diagrammatically in perspective two cable connectors located opposite each other for a ribbon cable which can be connected to a four-row connector according to the invention.

As mentioned earlier, it may be necessary, particularly in elaborate systems, to connect parts of one connector with parts of another connector or with another printed circuit board. At the bottom left in FIG. 8, four adjoining cable connectors 36 of the type illustrated in FIG. 9 are shown mounted to the connector 13. The cable connectors 36 adjoin each other in FIG. 8 without loss of space for one or more contact elements.

In FIG. 9, two cable connector modules having a housing 36 with two rows of contact openings located opposite each other at a distance are shown diagrammatically in perspective on an enlarged scale. The ribbon cables 37 has conductors disposed opposite each other in the open channels 38 of the respective cable connectors. The channels extend in the column direction of the contact elements from one side of the housing to the other to prevent these conductors making undesired electrical contact with each other. The contact elements of the cable connectors 36 are so arranged that only one connecting end of a contact element is situated in each channel 38 so that, if two ribbon cable connectors are positioned opposite each other, the respective contact elements in the same column are separated from each other over at least a distance of one position. By further providing that the end of a ribbon cable 37 to be received in a cable connector has a course corresponding to the siting of the connecting ends of the contact elements so that after assembly of the ribbon cable, the conductors of the contacting extremities do not project beyond the housing 36, the ends of the contacted conductors will then not touch each other when the cable connectors are mounted opposite each other.

The contact elements can, of course, be arranged in different ways. For example, adjoining contact elements of a two-row cable connector with an even number of columns can each be located in a different row with the end of the ribbon cable 37 to be received in the cable connector having a castellated course. As mentioned above, the contact elements may have a flat base section from which contact fingers or a contact pin extend with the connecting end being designed as a plug-on contact (not shown). The pitch distance between the contact elements is preferably 2 mm. In FIG. 9, similarly to FIG. 7, projections 39, which can be broken away, are attached to avoid erroneous contacting.

Figure 10:
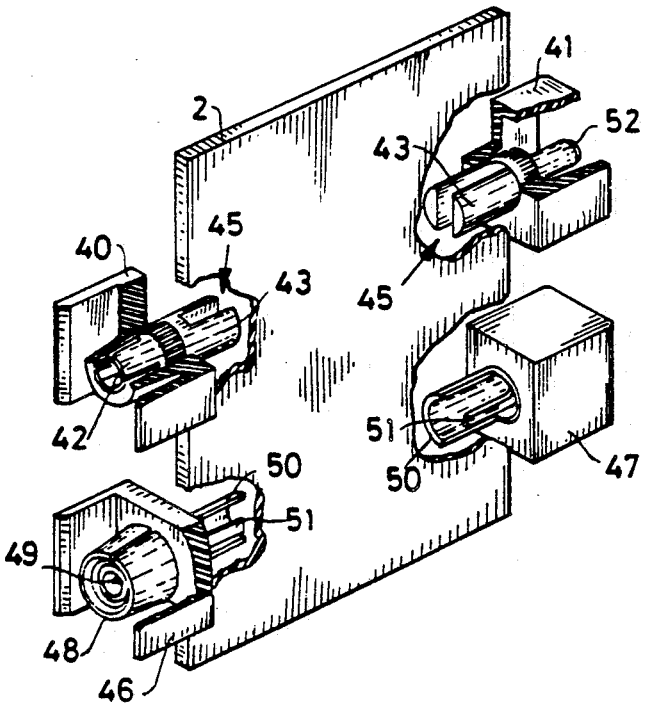
FIG. 10 shows diagrammatically in perspective power and coaxial connectors connected surface mounted to a printed wiring board.

FIG. 10 shows diagrammatically in perspective and in partially cut-away view, power connectors 40, 41 and coaxial connectors 46, 47 for connecting by surface mounting feed cables and coaxial cables to a printed circuit board. Connectors previously described are less suitable for connecting feed cables carrying a relatively large current.

The unipolar power connector 40 is essentially constructed from a contact socket 42 of electrically conducting material having a spring-loaded contact end for receiving a contact pin and an elongated socket-shaped connecting end 43 for connection to a printed wiring board. the power connector 41 has a pin-shaped contact end 52 and a similar socket-shaped connecting end 43. In order to make it possible to connect the connecting end to a printed circuit board by surface mounting, the elongate connecting end 43 is provided, according to the invention, with a slot-shaped recess 45 in which the printed circuit board 2 may be received so that the connecting end 43 can be connected to the printed circuit board 2 at the two opposite flat sides thereof.

For connecting coaxial plugs, coaxial connectors 46, 47 are used in practice. These connectors have an elongated outermost contact of socket 48 and innermost contact socket 49 which are electrically insulated from each other and respectively an outermost contact socket and an innermost contact pin (not shown) of electrically conducting material.

To permit surface mounting of the coaxial connectors to a printed circuit board, a part of the connecting end of the outermost contact socket 48 is removed from the circumference so that the remaining, virtually semicylindrical connecting end 50 can be connected to one side of the printed circuit board 2. Part of the jacket of the innermost contact socket 49, or the innermost contact pin, is removed so that the remaining connecting tongue 51 can be connected to the other side of the printed circuit board 2.

The connectors designed in this manner possess sufficient mechanical stability and a sufficiently large contact surface so that reliable and mechanically stable connections with a printed circuit board can be made by surface mounting technique. In practice, of course, it is possible, as a departure from the embodiments shown in FIG. 10, for several coaxial connectors and/or several power connectors to be accommodated in a single module housing.

It will be clear that the invention is not limited to the preferred embodiments thereof described and shown in the drawings, but that other variations and modifications are possible. For example, the connector modules may include optoelectronic connectors connected to optical fiber cables, shielded connectors, to locking means or so called polarity indicators to prevent incorrect connection of the connector modules, etc., all without deviating from the scope and the concept of the invention.

I claim:

1. A connector for mounting to a printed circuit board comprising a housing of electrically insulative material, a plurality of contact elements arranged in said housing in rows and columns, said rows disposed substantially parallel to the circuit board and said column disposed substantially transverse to the circuit board, each of said contact elements having a base section with a contact portion and a connecting portion extending from opposite sides of said base section, the connecting portion projecting from one side of the housing facing the circuit board and adapted for mounting to contact surfaces on said circuit board, one row of openings formed in said one side of the housing and extending in the longitudinal direction of the housing and adjacent a side wall thereof, the connecting portions of adjacent contact elements in the same column being displaced in the direction of the row so as to contact surfaces on said printed circuit board offset relative to one another.

2. A connector according to claim 1, wherein the connecting portions of said contact elements are inclined in the direction of a plane extending transversely to said one side of the housing in the lengthwise direction thereof, said connecting portions contacting either one or both sides of the printed circuit board disposed in the plane.

3. A connector according to claim 2, wherein each connecting portion has near its free end a flat portion lying parallel to the imaginary plane to permit surface mounting to the printed circuit board.

4. A connector according to claim 3, wherein the free end of each connecting portion is bent backwards relative to the plane in order to form a funnel for readily receiving the printed circuit board.

5. A connector according to claim 2 wherein the contact elements are arranged in four rows, two of said rows of contact elements being disposed on one side of the plane and two of said rows being disposed on said other side of said plane, the connecting portions of adjacent contact elements in the same column being mutually displaced on each side of the plane.

6. A connector according to claim 5 where each contact element has a flat base section and the connecting portions are formed as flat connecting tongues integral with the base section, each said connecting tongues being located at an edge of the base section.

7. A connector according to claim 6, wherein the free end of the connecting tongues of adjacent contact elements in a column extend on one side of the plane over different distances from said one side of the housing.

8. A connector according to claim 1 wherein the pitch distance between adjacent contact elements is 2 mm.

9. A connector according to claim 1 wherein the wall thickness of the housing at the end edges is equal to or less than one-half the pitch distance between adjacent contact elements in a row.

10. A connector according to claim 1 wherein the contact portions of the contact elements are contact pins and wherein the contact pin of at least one of the contact elements in a column has a length different than the contact pins of the other contact elements in the same column.

11. A protective plate for use with connector according to claim 1, said protective plate comprising teeth disposed along at least one of its edges, said teeth being adapted for insertion in said one row of openings in the housing of the connector so that when assembled, the protective plate extends parallel to the said plane.

12. A protective plate according to claim 11, wherein said teeth are formed on an elongated rail of electrically insulating material, said rail being disposed near said edge of the protective plate, the teeth being disposed at a distance from the surface of the protective plate.

13. A protective plate according to claim 12, wherein said protective plate extends on both sides on the elongated rail.

14. A protective plate according to claim 11, wherein said protective plate further comprises openings formed in the plane of the plate, said openings adapted to secure the protective plate to the printed circuit board.

15. A cable connector for a ribbon cable mated with a connector according to claim 1, said cable connector comprising a housing of electrically insulating material with a plurality of contact elements arranged in rows and columns, each contact element having a connecting portion formed as a plug-on contact for connecting a conductor of the ribbon cable, said cable connector having a plurality of open channels extending in the column direction of the contact elements, from one side of the housing to the other side of the housing said channels receiving the conductors of the ribbon cable from said one side, only one plug-on contact being located in each channel, the contact elements being arranged in a manner such that, if two cable connectors are positioned so that said other side of the housing of each said connector module is adjacent each other, the respective contact elements in the same column will be separated from each other by a distance of at least one position.

16. A cable connector according to claim 1 herein said cable connector comprises two rows and an even number of columns, the plug-on contacts disposed in adjacent channels each being arranged in another row.

17. A cable connector according to claim 15 wherein the pitch distance between adjacent contact elements is 2 mm.

18. A cable connector according to claim 15, wherein the housing of said cable connector has external dimensions such that two or more cable connectors can be positioned adjacent to each other without space loss for one or more contact elements.

19. A contact element for use in the connector of claim 1 wherein the contact portion comprises two resilient contact fingers projecting from the flat base section with contact surfaces located at the free ends thereof, the contact fingers extending symmetrically relative to a center line in the longitudinal direction of the contact element and, at the end connected to the flat base section, being bent out of the plane of the base section over a portion of their length in opposite directions, the two contact fingers being bent towards each other again at the end of this portion so that the contact surfaces are located opposite each other.

20. A contact element for use in the connector of claim 1 wherein the contact portion of the contact element is a contact pin projecting from the base section.

21. A connector according to claim 10, wherein the contact pin of at least one contact element is longer.

22. A modular connector system comprising a plurality of connector modules mounted to a printed circuit board, each said connector modules having a housing of electrically insulative material, a plurality of contact elements arranged in said housing in rows and columns, said rows disposed substantially parallel to the circuit board and said columns disposed substantially transverse to the circuit board, each of said contact elements having a base section with a contact portion and a connecting portion extending from opposite sides of said base section, the connecting portion projecting from one side of the housing facing the circuit board and adapted for mounting to contact surfaces on said circuit board, the connecting portions of adjacent contact elements in the same column being displaced in the direction of the row so as to contact surfaces on said printed circuit board offset relative to one another, one of said connector modules having contact elements wherein the connecting portions are contact pins, at least one cable connector module for ribbon cable being mated to said connector module having contact pins, said cable connector module including a housing of electrically insulating material with a plurality of contact elements arranged in rows and columns, each contact element having a connecting portion formed as a plug-on contact for connecting a conductor of the ribbon cable, said cable connector having a plurality of open channels extending in the column direction of the contact elements, from one side of the housing to the other side of the housing, said channels receiving the conductors of the ribbon cable from said one side, only one plug-on contact being located in each channel, the contact element being arranged in a manner such that, if two cable connector modules are positioned so that said other side of the housing of each said connector module is adjacent each other, the respective contact elements in the same column will be separated from each other by a distance of at least one position.

23. A modular connector system comprising a plurality of connector modules mounted to a printed circuit board, each said connector modules having a housing of electrically insulative material, a plurality of contact elements arranged in said housing in rows and columns, said rows disposed substantially parallel to the circuit board and said column disposed substantially transverse to the circuit board, each of said contact elements having a base section with a contact portion and a connecting portion extending from opposite sides of said base section, the connecting portion projecting from one side of the housing facing the circuit board and adapted for mounting to contact surfaces on said circuit board, a protective plate extending parallel to said circuit board and having teeth disposed along an edge of said protective plate, said teeth adapted for insertion in a row of openings formed in said one side of the housing of the connector modules, the connecting portions of adjacent contact elements in the same column being displaced in the direction of the row so as to contact surfaces on said printed circuit board offset relative to one another.

24. A modular connector system according to claim 23 wherein at least one of said connector modules has contact elements wherein the connecting portions are contact pins.

25. A modular connector system according to claim 23 where at least one of said connector modules has contact elements wherein the connecting portions are female contacts.

26. A modular connector system according to claim 25 wherein each said female contact comprises two resilient contact fingers projecting from the flat base section with contact surfaces located at the free ends thereof, the contact fingers extending symmetrically relative to a center line in the longitudinal direction of the contact element and, at the end connected to the flat base section, being bent out of the plane of the base section over a portion of their length in opposite directions, the two contact fingers being bent towards each other again at the end of this portion so that the contact surfaces are located opposite each other.

27. A modular connector system according to claim 24 further comprising at least one cable connector module for ribbon cable which is mated to at least one of said connector modules having contact pins.

28. A modular connector system according to claim 23 further comprising at least one power connector module and at least one coaxial connector module.

29. A modular connector system according to claim 28 wherein said power connector module comprises at least one contact socket or pin, surrounded by a housing, with an elongated connecting portion of electrically conducting material for connecting the power connector to a printed circuit board, said connecting portion being provided with a slot-shaped opening in which the printed circuit board can be received for connecting the power connector to one or both flat sides of said board by the surface mounting means.

30. A modular connector system according to claim 28 wherein said coaxial connector module comprises at least one outermost and one innermost contact socket or pin, mutually electrically insulated and surrounded by a housing, and having connecting portions of electrically conducting material for connecting the coaxial connector to a printed circuit board, the outermost contact socket having a connecting portion for connecting it to one side of the printed circuit board and the innermost contact socket or pin having a connecting portion for connecting it to the other side of the printed circuit board by the surface mounting means.

31. A modular connector system according to claim 30 wherein the connecting portion of the outermost contact socket is a virtually half-cylindrical portion of said contact socket extending outside the housing and the connecting portion of the innermost contact socket or pin is a connecting tongue.

32. A modular connector system according to claim 23 wherein said teeth are formed on an elongated rail of electrically insulating material, said rail being disposed near said edge of the protective plate, the teeth being disposed at a distance from the surface of the protective plate and said protective plate extends on both sides of the elongated rail.

33. A modular connector system according to claim 32 wherein said protective plate further comprises openings formed in the plane of the plate, said openings adapted to secure the protective plate to the printed circuit board.

34. A modular connector system according to claim 33 comprising two protective plates, one mounted on each flat side of the printed circuit board, said plates providing both mechanical and electrical protection to electronic components mounted on the printed circuit board.

* * * * *